United States Patent [19]

Petrimaux et al.

[11] 4,402,254

[45] Sep. 6, 1983

[54] PNEUMATIC STARTER DEVICE

[75] Inventors: Eric Petrimaux, Evreux; Michel Nicolas, Plaisir; Pierre Prudhomme, St. Germain en Laye; Daniel Boutielle, Ville D'Avray, all of France

[73] Assignee: La Telemecanique Electrique, France

[21] Appl. No.: 211,966

[22] Filed: Dec. 1, 1980

[51] Int. Cl.[3] ..... F15B 13/04

[52] U.S. Cl. ..... 91/29; 91/31; 91/446; 137/110

[58] Field of Search ..... 137/110; 91/29, 31

[56] References Cited

U.S. PATENT DOCUMENTS

| | | | |
|---|---|---|---|
| 2,524,114 | 10/1950 | Millat | 91/29 X |
| 3,089,512 | 5/1963 | Julien | 251/29 X |
| 3,572,363 | 3/1971 | Roach | 137/110 X |
| 3,834,621 | 9/1974 | Pacht | 137/110 X |
| 4,011,883 | 3/1977 | Petrimaux | 137/110 |
| 4,075,928 | 2/1978 | Bitonti | 91/29 |
| 4,294,113 | 10/1981 | Sprott | 137/110 X |

*Primary Examiner*—Robert G. Nilson

*Attorney, Agent, or Firm*—William A. Drucker

[57] ABSTRACT

A progressive pneumatic starter device delivers at its outlet an increasing pressure of low flow rate, then a working pressure at a high flow rate. The starter device is provided with a distributor member adapted to connect, in parallel with a calibrated bore, a channel of large section, when a pressure which is greater than a predetermined threshold and which is not derived from the outlet is applied to the distributor member. The starter device is advantageously placed upstream of a pneumatic switch to which it is directly associated for the purpose of shortening its channels for transfer of fluid.

3 Claims, 5 Drawing Figures

PNEUMATIC STARTER DEVICE

BACKGROUND OF THE INVENTION

The invention relates to a progressive pneumatic starter device comprising an entry orifice fed with a fluid under pressure, an exhaust orifice adapted to be coupled to a pressure fluid utilisor device, a channel permanently coupling the entry orifice to the exhaust orifice and having a small cross-section in relation to these orifices, a movable switching member having a first rest position provided by a spring and in which it does not establish any communication between the entry and the exhaust, and having a second working position in which it establishes a communication of large cross-section between the said entry and the said exhaust and compresses the said spring, and comprising a control channel terminating at the said switching member, this control channel receiving pressure signals which place the switching member in its first position when this control pressure exceeds a certain limit.

PRIOR ART

In the known apparatuses having this general construction referred to hereinabove, the control channel is directly coupled to the exhaust orifice, and the entry and exhaust orifices are coupled to the pressure source, and respectively to the utilisor devices, by channels which may have a certain length, taking into consideration the remote position which these apparatuses generally have in relation to the utilisor devices.

As a result, if such an apparatus is used, the function of which is to deliver at its output a pressure evolving progressively from a small value up to a pressure equal to the pressure present at the entry, the states of the switching member are dependent solely upon the pressure existing at the output.

This situation has numerous inconveniences, in particular when between the utilisor devices and the starter device there is placed a pneumatic switching means.

In effect, if the switching means is in a state in which it is not permitting the passage of fluid, and consequently its entry for fluid under pressure is closed off internally, a pressure equal to the feed pressure is established simultaneously at the entry of the switching means and at the exhaust of the starter device, in such a manner that the switching member of the latter takes up the working position; when the switching means is placed in a state permitting fluid to pass, it is necessary to wait until the high pressure fluid, which is going to circulate instantaneously, has had its pressure lowered below a certain value, in order that the starter device may pass again into its rest position and thereafter deliver a fluid at a regularly increasing pressure.

As a result, the slowing effect which it is desired to obtain from the starter device cannot be used instantaneously and accidents can happen during the abrupt application of the pressure on utilisor devices such as jacks.

This inconvenience is further aggravated if a long channel couples the output of the starter device to the entry of a switching means, because the time necessary for the compressed fluid in this channel to have its pressure lowered below the said value will be greater still, by reason of the volume of fluid enclosed between the two apparatuses.

Furthermore, it is to be feared that the use of a progressive starter device may give serious inconveniences if a pneumatic switching means is placed upstream of a starter device. In effect, the switching means used most often couple, in their blocking position, the downstream channel feeding, for example, jacks through distributing means, to a local escapement to carry out a very rapid purge of this downstream channel, as a result if a starter device is placed between the outlet of the switching means and the downstream channel, a rapid purge of this latter would be impossible, because the fluid contained in the said channel would then have to pass through the calibrated channel of small cross-section before being able to reach the local outlet of the switching means.

OBJECT OF THE INVENTION

The invention accordingly proposes to provide first of all a progressive starter device the construction of which permits piloting thereof by a pressure separate from that which is presented at its outlet, whilst considerably reducing the defects inherent to channels of considerable length, and accordingly to provide a circuit permitting the advantageous connecting of this starter device to switching means and to utilisor apparatuses such as distributors controlling jacks.

SUMMARY OF THE INVENTION

According to the invention, this first result is achieved by reason of the fact that the outlet orifice is placed on a first face of the starter device which has first coupling means adapted to cooperate with second coupling means carried by a utilisor apparatus, in particular by a switching means itself having a coupling face provided with an entry orifice and coupling means, and that the control channel terminates at a control orifice situated on a second face of the starter device.

BRIEF DESCRIPTION OF THE DRAWINGS

Means for the obtaining of a second result, as well as other features of the invention, will appear from reading of the following description with reference to the drawings, wherein.

DESCRIPTION OF THE PREFERRED EMBODIMENTS

Figure 1:
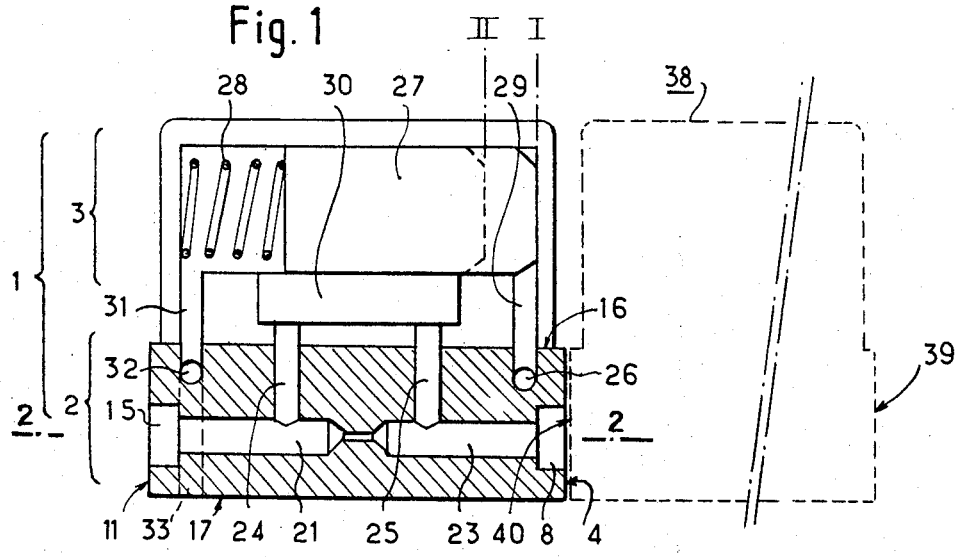
FIG. 1 is a schematic sectional view of the starter device according to the invention.

A progressive pneumatic starter device 1 such as can be seen in FIG. 1 comprises a first half-body or base 2 adapted to be secured on a support and a second half-body 3 fixed in removable manner on the first one. This construction, which facilitates manufacture, by no means excludes the possibility of making the apparatus in a single body.

Figure 2:
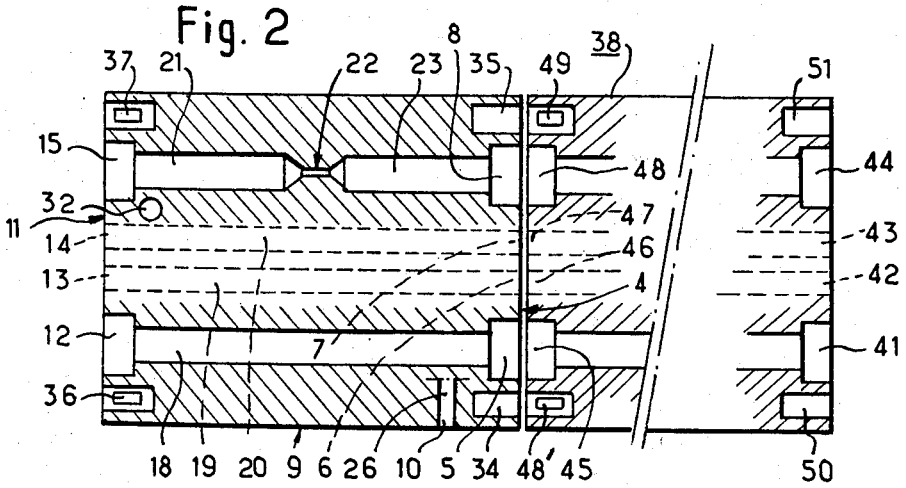
FIG. 2 is a schematic sectional view of the starter device taken on the plane 2—2 of FIG. 1.

In the example described, see also FIG. 2, the base comprises a first face 4 having orifices 5, 6, 7, 8, a second face 9 substantially perpendicular to the first one and having an orifice 10, a third face 11 parallel to the first one and having orifices 12, 13, 14, 15, a fourth face 16 intended to receive the half-body 3, and a fifth face 17 intended for fixing.

Channels 18, 19, 20 directly couple, through the base, the respective orifices 5 and 12, 6 and 13 and 7 and 14.

The orifice 15, which constitutes the entry orifice, is extended in the base by a portion of channel 21 of large cross-section, which is coupled by a channel 22 of fixed or adjustable size, of cross-section small in comparison with the former, to a second portion of channel 23 of large cross-section terminating at the orifice 8, this latter constituting the outlet orifice.

Figure 3:
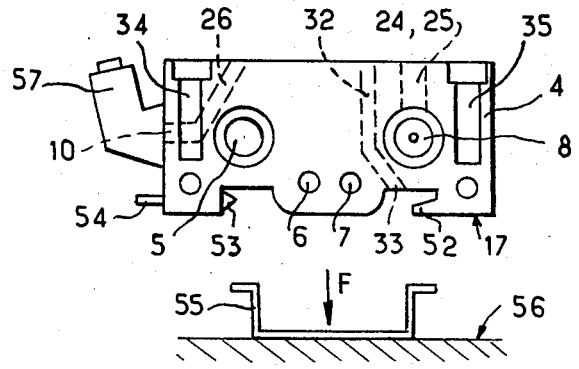
FIG. 3 is an elevation of the starter device.

By referring to FIG. 1 and to FIG. 3, it will be seen that the channel 21 communicates with a channel 24 terminating at the face 16, that the channel 23 communicates with a channel 25 terminating at the face 16, and that the orifice 10 is extended by a channel 26 terminating likewise on the face 16.

The half-body 3 comprises a switching member represented schematically at 27 which can move between a first position I of rest, which is that of this figure, and a second position II of operation for which it will have been displaced towards the left with compression of a spring 28; the displacement towards the left is caused by the application of a pressure in the channel 29 of 3 which is coupled to the channel 26 and thus to the orifice 10. The movements of the switching member are transmitted to a slide 30 shown schematically and the function of which is to couple the channels 24 and 25 for the said working position and to interrupt this coupling for the said rest position; a channel 31 of the half-body 3 communicates with the switching member and with a channel 32 of the base terminating at an exhaust orifice 33, placed for example on the face 17, to permit the passage of the air when the member 27 moves in the two directions.

By referring to FIGS. 2 and 3, it will be seen that the face 4 and the face 11 are provided with first coupling means 34, 35 and respectively with second coupling means 36, 37 placed in the vicinity of the orifices 5 to 8 and respectively 12 to 15; these coupling means, which comprise for example screws and bearing faces placed at will on one or the other surface, are analogous to those which may be present on utilisor devices which are connectable one to another.

A pneumatic apparatus adapted to be associated with a progressive starter device is shown at 38 in FIGS. 1 and 2; itself it comprises respective first and second connecting faces 39 and 40, respectively having orifices 41, 42, 43, 44 and 45, 46, 47, 48, as well as coupling means 50, 51 identical to the means 34, 35, and respectively 48', 49 complementary to those which are placed oppositely on the starter device at 34, 35.

The face 17, as can be seen from FIG. 3, comprises fixed engaging means constituted by a longitudinal hook 52 and movable resilient locking means 53, 54 to assure the fixation of the base in the direction of the arrow F on a conventional profile 55 disposed permanently on a support 56.

A connector 57, preferably orientatable, is placed in the orifice 10 to conduct pneumatic pilot signals to the switching member 27 and to communicate thereto its positions of working and of rest. The operation of the progressive starter device will be apparent upon considering firstly that a permanent pressure P is present at the entry orifice 15, that no signal of pressure is present at the orifice 10, and that a utilisor device is coupled to the outlet orifice 8.

When this utilisor device is not in a state of consuming fluid, the pressure at the entry orifice produces a small current of fluid through the channel 22 until the moment when the pressure in the channel 23 reaches the same value. When this utilisor device is in a state of consuming fluid, the pressure in the channel 23 will be established much more slowly before reaching a value near to that present at the input, but this utilisor device will not be able to absorb the quantity of fluid which it is capable of consuming, because of the presence of the channel of small cross-section.

If a pilot signal is applied to the orifice 10 at an instant when the pressure in the channel 23 achieves a certain value close to that present at the input, the switching member will take up its working position and will permit a large quantity of fluid to circulate from the entry 15 towards the outlet 8 through the slide 30 in order to feed the utilisor device which will consequently not be submitted to any jerk in its operation when starting.

Such an evolution of the pressure is particularly interesting when the utilisor devices are distributors controlling jacks.

The placing into operation of jacks, each fed by a distributor, often requires the necessity to place a pneumatic switching means on the feeding conduit of certain distributors.

Figure 4:
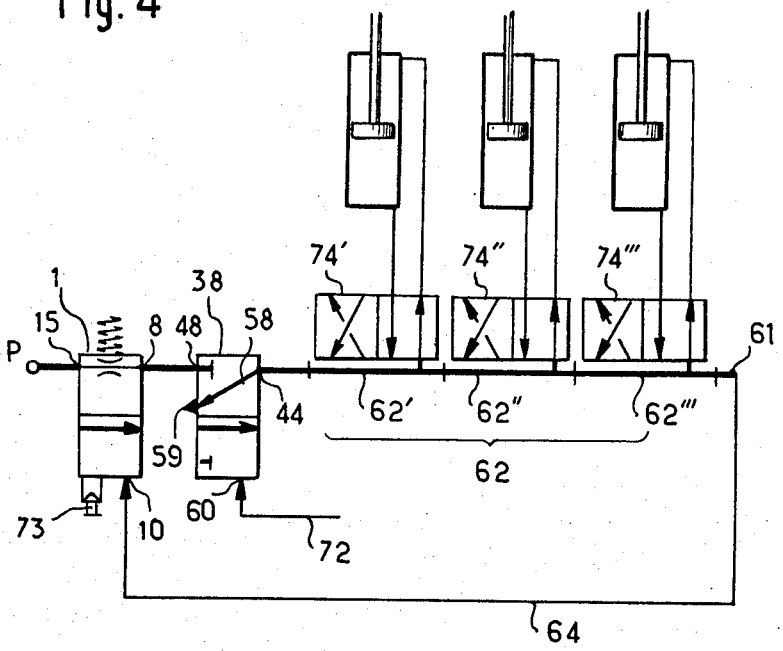
FIG. 4 is a first circuit for association of a starter device in accordance with the invention with utilisor apparatuses such as jacks, and with a pneumatic switch.
Figure 5:
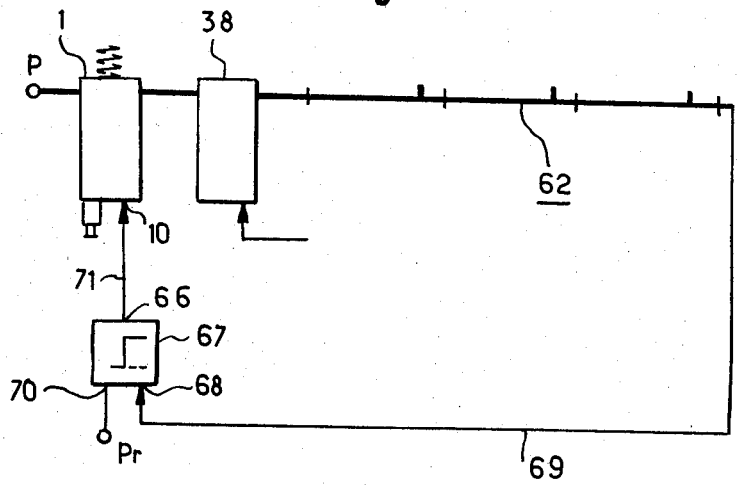
FIG. 5 is a second circuit constituting an improvement.

As is shown in the circuit of FIG. 4, a pneumatic switching means 38 comprises a distribution member 58 which directs its outlet 44 either towards its entry 48, or towards an exhaust 59 according to whether or not a pneumatic control signal is applied at a control input 60 which it comprises.

The construction of such a switching means 38 is such that its association with the starter device will be advantageous by placing it directly between the said starter device 1 and the utilisor devices 74, 63, and coupling through a conduit 64 the pilot orifice 10 of the starter device to the end 61 of the feed conduit 62 of the utilisor devices, this conduit 62 being itself coupled to the outlet 44 of the switching means.

In effect, when the switching means 38 is in its blocked state and, as a result, the feed conduit 62 of the utilisor devices is coupled to the exhaust 59, a rapid purge of the utilisor devices can be carried out, whilst if the starter device is placed between the switching means and the utilisor devices, this purge is considerably slowed down. Furthermore, the fact of drawing the pressure necessary for the piloting of the starter device 1 from the conduit 62 permits the very rapid return of the starter device to its rest position, which makes it adapted to fulfil yet again its function of progressive starting in a very short time. For constructional reasons, the pilot pressure will be taken off preferably at the end 61, and particularly when the utilisor devices will be distributors 74', 74'', 74''' associated one against another and when the feed conduit 62 is formed by the juxtaposition of successive short lengths 62', 62'', 62''' of these distributors.

As a variation of the preceding circuit, it is likewise possible to feed the pilot orifice 10 of the starter device by coupling it through a channel 71 to the outlet 66 of a pneumatic threshold relay 67 having a control input 68 which communicates through a channel 69 with the feed conduit 62 and a reference input 70 coupled to a fixed or adjustable reference pressure Pr. When the feed pressure in conduit 62 exceeds the reference pressure Pr, the switching member 27 will take up its working position and, therefore, the utilisor devices will receive their full working pressure. The control input 60 of the switching means is coupled by a special conduit 72, for example, to a pneumatic switching means, not shown, which can be actuated for purposes of control, or of adjustment, or of safety.

Still further, a removable pilot member 73 will be placed in the half-body 3 of the starter device, in such a manner as to be able to be actuated from the exterior by hand or electrically in order to provide pilot signals to the switching means independently of those which may end up at the orifice 10.

The channels 18, 19, 20 passing through the base 2 serve both for conveying auxiliary fluids through 19 and 20, and for carrying the exhausts as done by channel 18.

This connectable progressive starter device and the circuit for placing it in operation are advantageously used for controlling the feeding of distributors which are adapted to be connected one to another, and with switching means, for the purpose of providing compact and effective power control units.

We claim:

1. In combination with a double acting pneumatic motor, a progressive pneumatic starter device having supply and outlet ports, a supply valve having an inlet port connected to the outlet port of said progressive pneumatic starter device, said supply valve further having outlet and exhaust ports and means, movable from a first to a second position, for connecting the outlet port to the inlet port of the supply valve in the said first position and for connecting the outlet port to the exhaust port of the supply valve in the said second position, a control valve for said double acting pneumatic motor and a supply line having a first end connected to the outlet port of said supply valve and a second end connected to the said control valve, said progressive pneumatic starter device further comprising first and second unrestricted channel portions respectively connected to the supply and outlet ports and a third restricted channel portion permanently connecting said first and second unrestricted channel portions together, first and second unrestricted passages respectively connected to said first and second unrestricted channel portions, pneumatic switching means having a work state in which it establishes a communication between the said first and second passages, and having a rest state in which it prevents the said communication, said pneumatic switching means having a control inlet and being switched from its rest state to its work state each time the air pressure applied at the said control inlet exceeds a predetermined value and a control line connecting the said second end of the supply line to the said control inlet of the pneumatic switching means.

2. The combination of claim 1, in which the outlet port of the progressive pneumatic starter device is directly coupled to the inlet port of the supply valve.

3. The combination of claim 1, in which the said control line has pneumatic threshold relay means having an adjustable threshold and interposed between said second end of the supply line and the control inlet of the pneumatic switching means.

* * * * *